US008874268B2

(12) United States Patent
Kim et al.

(10) Patent No.: US 8,874,268 B2
(45) Date of Patent: Oct. 28, 2014

(54) ROBOT CLEANER

(75) Inventors: Bong-Ju Kim, Changwon-si (KR); In-Bo Shim, Changwon-si (KR); Ji-Hoon Sung, Changwon-si (KR); Byung-Doo Yim, Changwon-si (KR); Sung-Guen Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 485 days.

(21) Appl. No.: 13/380,740

(22) PCT Filed: Jul. 6, 2009

(86) PCT No.: PCT/KR2009/003675
§ 371 (c)(1),
(2), (4) Date: Dec. 23, 2011

(87) PCT Pub. No.: WO2011/004916
PCT Pub. Date: Jan. 13, 2011

(65) Prior Publication Data
US 2012/0095597 A1 Apr. 19, 2012

(51) Int. Cl.
*G06F 19/00* (2011.01)
*A47L 9/10* (2006.01)

(52) U.S. Cl.
USPC ..... 700/258; 15/347; 15/340.1; 55/283

(58) Field of Classification Search
USPC ..... 15/347, 339, 352, 340.1, 319; 700/258, 700/245, 259; 55/283
See application file for complete search history.

(56) References Cited

U.S. PATENT DOCUMENTS

| | | | | |
|---|---|---|---|---|
| 7,891,796 | B2 * | 2/2011 | Masuyama et al. | 347/93 |
| 8,205,982 | B2 * | 6/2012 | Masuyama et al. | 347/103 |
| 8,657,395 | B2 * | 2/2014 | Masunaga et al. | 347/6 |
| 8,732,901 | B2 * | 5/2014 | Shim et al. | 15/347 |
| 2007/0070163 | A1 * | 3/2007 | Masuyama et al. | 347/104 |
| 2008/0229719 | A1 * | 9/2008 | Hayama et al. | 55/283 |
| 2010/0328393 | A1 * | 12/2010 | Masuyama et al. | 347/16 |
| 2012/0023699 | A1 * | 2/2012 | Shim et al. | 15/319 |
| 2012/0095597 | A1 * | 4/2012 | Kim et al. | 700/259 |

FOREIGN PATENT DOCUMENTS

| | | | |
|---|---|---|---|
| EP | 1 719 442 | A2 | 11/2006 |
| EP | 1 752 077 | A2 | 2/2007 |
| GB | 2 371 216 | A | 7/2002 |
| KR | 10-2005-0056657 | A | 6/2005 |
| KR | 10-2006-0115220 | A | 11/2006 |
| KR | 10-2007-0018641 | A | 2/2007 |
| KR | 10-0692577 | B1 | 3/2007 |

OTHER PUBLICATIONS

International Search Report dated Mar. 22, 2010 issued in Application No. PCT/KR2009/003675.
European Search Report dated Dec. 16, 2013 issued in Application No. 09 84 7111.
Korean Notice of Allowance dated Dec. 27, 2013 issued in Application No. 10-2012-7005881.

* cited by examiner

*Primary Examiner* — Ronnie Mancho
(74) *Attorney, Agent, or Firm* — KED & Associates, LLP

(57) ABSTRACT

Provided is a robot cleaner, and more particularly to a robot cleaner which detest whether a foreign material storage unit is separated. The robot cleaner includes a main body including a suction motor, a foreign material storage unit separably disposed within the main body, the foreign material storage unit storing foreign materials contained in sucked air, a foreign material cover for selectively shielding one side of the foreign material storage unit, and a detection unit for detecting whether the foreign material cover is opened.

10 Claims, 12 Drawing Sheets

ROBOT CLEANER

BACKGROUND

Embodiments relate to a robot cleaner which perform cleaning while moving by oneself.

In general, a cleaner is a device that sucks air containing dusts using a suction force generated by a suction motor mounted in a main body thereof to filter the dusts within the main body.

Such a cleaner may be classified into a manual cleaner that is directly manipulated by a user and a robot cleaner that performs cleaning for one self without being manipulated by the user.

A general robot cleaner uses a charged battery as a power source. The robot cleaner performs cleaning for oneself while moving along a bottom of an area to be cleaned according to an inputted program. Thus, the robot cleaner is being developed and used into various types in line with needs of modern man which pursues reduced cleaning time and convenience.

The robot cleaner includes a main body defining an outer appearance thereof and a duct container disposed inside the main body.

Air sucked into the robot cleaner may be sucked into the duct container via a predetermined path. Here, the dusts may be filtered while passing through the duct container. Then, when the duct container is filled with some dusts, the user may empty the dust container to perform the cleaning.

In the robot cleaner according to a related art, since the dust container is disposed inside the main body of the cleaner, the user does not know whether the dust container is installed. Thus, there is a limitation that the cleaner may be operated in a state where the duct container is not installed.

In this case, air sucked into the cleaner may not be filtered to accumulate dusts within the main body. Also, dusts which are not stored in a predetermined position may be flied to the outside of the cleaner, thereby causing unsanitary environment.

SUMMARY

Embodiments provide a robot cleaner which detects whether a foreign material storage unit is mounted.

Embodiments also provide a robot cleaner in which a foreign material cover is selectively coupled according to whether a foreign material storage unit is mounted on the cleaner.

In one embodiment, a robot cleaner includes: a main body including a suction motor; a foreign material storage unit separably disposed within the main body, the foreign material storage unit storing foreign materials contained in sucked air; a foreign material cover for selectively shielding one side of the foreign material storage unit; and a detection unit for detecting whether the foreign material cover is opened.

The details of one or more embodiments are set forth in the accompanying drawings and the description below. Other features will be apparent from the description and drawings, and from the claims.

DETAILED DESCRIPTION OF THE EMBODIMENTS

Hereinafter, exemplary embodiments will be described with reference to the accompanying drawings. The invention may, however, be embodied in many different forms and should not be construed as being limited to the embodiments set forth herein; rather, that alternate embodiments included in other retrogressive inventions or falling within the spirit and scope of the present disclosure will fully convey the concept of the invention to those skilled in the art.

Figure 1:
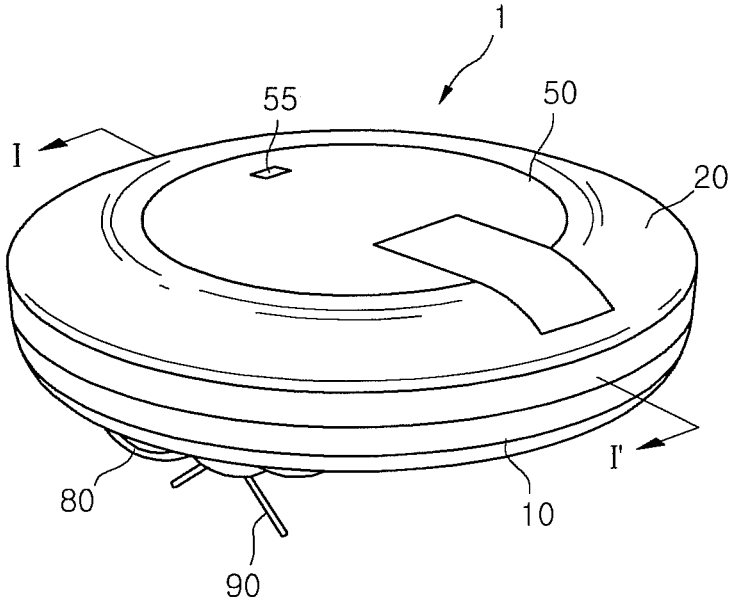
FIG. 1 is a perspective view of a robot cleaner according to a first embodiment.
Figure 2:
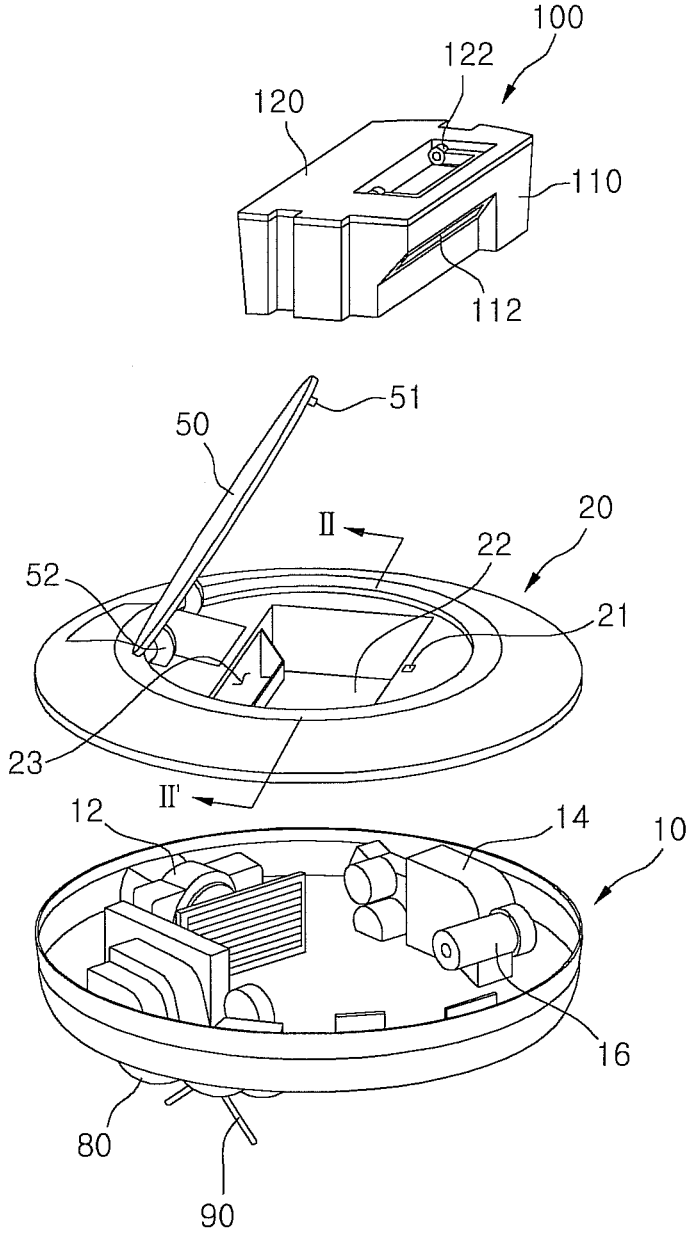
FIG. 2 is an exploded perspective view of the robot cleaner according to the first embodiment.

FIG. 1 is a perspective view of a robot cleaner according to a first embodiment. FIG. 2 is an exploded perspective view of the robot cleaner according to the first embodiment.

Referring to FIGS. 1 and 2, a robot cleaner 1 according to a first embodiment includes a main body 10 defining an outer appearance thereof, a first cover 20 covering an upper portion of the main body 10, a second cover 50 disposed on the first cover 20 to selectively shield a portion of an opened top surface of the first cover 20, and a foreign material storage unit 100 storing foreign materials contained in air sucked therein.

A moving wheel 80 for easily moving the robot cleaner 1 is disposed on a bottom surface of the main body 10. The moving wheel 80 may be provided in plurality of on both sides of the main body 10.

Also, a side brush 90 for collecting foreign materials of a cleaning surface toward a suction part (see reference numeral 18 of FIG. 5) of the cleaner 1 during the cleaning is disposed on each of both sides of the main body 10. The side brush 90 may be rotatably coupled to the main body 10.

The main body 10 includes a suction motor 12 serving as a drive unit providing a suction force for sucking the foreign materials and an agitator drive unit 16 which drives a wheel drive unit 14 providing a driving force for rotating the moving wheel 80 and an agitator (see reference numeral 60 of FIG. 5) for dusting the dusts of the cleaning surface when the cleaning.

Also, a seat part 22 for seating the foreign material storage unit 100 is disposed on the first cover 20. The seat part 22 may be recessed downward form an upper portion of the first cover 20. The seat part 22 may have a size corresponding to that of the foreign material storage unit 100.

A first communication part 23 communicating with the foreign material storage unit 100 is disposed at a side of the seat part 22. At least one portion of the first cover 20 may be opened and inclined in one direction to form the first communication part 23.

The second cover 50 is rotatably coupled to a side of the first cover 20 to selectively shield the opened top surface of the first cover 20. Since the opened top surface is disposed above the seat part 22, the second cover 50 may be rotatably coupled to an upper portion of the foreign material storage unit 100.

The first cover 20 may be called a "main cover" in that it 20 shields a side of the main body 10, and the second cover 20 may be called an "auxiliary cover" or "foreign material cover" in that it 20 is selectively opened to separate the foreign material storage unit 100.

A rotation lever 52 may be disposed on a side of the second cover 50 to rotate the second cover 50. The rotation lever 52 is rotatably inserted into the first cover 20.

Also, a hook protrusion 51 hooked on the first cover 20 is disposed on the second cover 50. The hook protrusion 51 may be disposed on an inner surface of the second cover 50. A hook 21 hooked with the hook protrusion 51 is disposed on the first cover 20. The hook 21 is disposed on a position corresponding to that of the hook protrusion 51 in a state where the second cover 50 is closed.

A push part 55 to be manipulated by a user to open the second cover 50 is disposed on an outer surface of the second cover 50. The push part 55 may be disposed on a side opposite to that of the hook protrusion 51.

When the push part 55 is pushed in a state where the second cover 50 is closed, the coupling between the hook protrusion 51 and the hook 21 may be released. Also, when the second cover 50 is closed in a state where the second cover 50 is opened, the hook protrusion 51 may be hooked on the hook 21.

That is, a hook structure between the hook protrusion 51 and the hook 21 may have a structure in which the hook protrusion 51 and the hook 21 are hooked when pushed once and released when hooked again once. The hook structure may be the previously well-known technology which can be applied to a general cover, and thus, the detailed descriptions thereof will be omitted.

The foreign material storage unit 100 includes a storage unit main body 110 for defining a storage space of the foreign materials and a storage unit cover 120 for covering an upper side of the storage unit main body 110. A handle 122 to be grasped by the user may be disposed on the storage unit cover 120.

A second communication part 112 communicating with the first communication part 23 is disposed in the storage unit main body 110. At least one portion of the storage unit main body 110 may be opened and inclined in a direction corresponding to that of the first communication part 23 to form the second communication part 112.

Air sucked into the robot cleaner 1 may be introduced into the foreign material storage unit 100 through the first and second communication parts 23 and 112. Here, the second communication part 112 may be called an "air inlet" of the foreign material storage unit 100, and the first communication part 23 may be called a "cover communication part".

In a state where the foreign material storage unit 100 is seated on the seat part 22, the second communication part 112 may contact a side of the first communication part 23. Here, the second communication part 112 may have a size corresponding to that of the first communication part 23.

When the foreign material storage unit 100 is seated on the first cover 20 and the suction motor 12 is driven, the first and second communication parts 23 and 112 may communicate with each other. However, when the operation of the suction motor 12 is stopped, the communication between the first and second communication parts 23 and 112 may be interrupted. The related description will now be described with reference to drawings.

Figure 3:
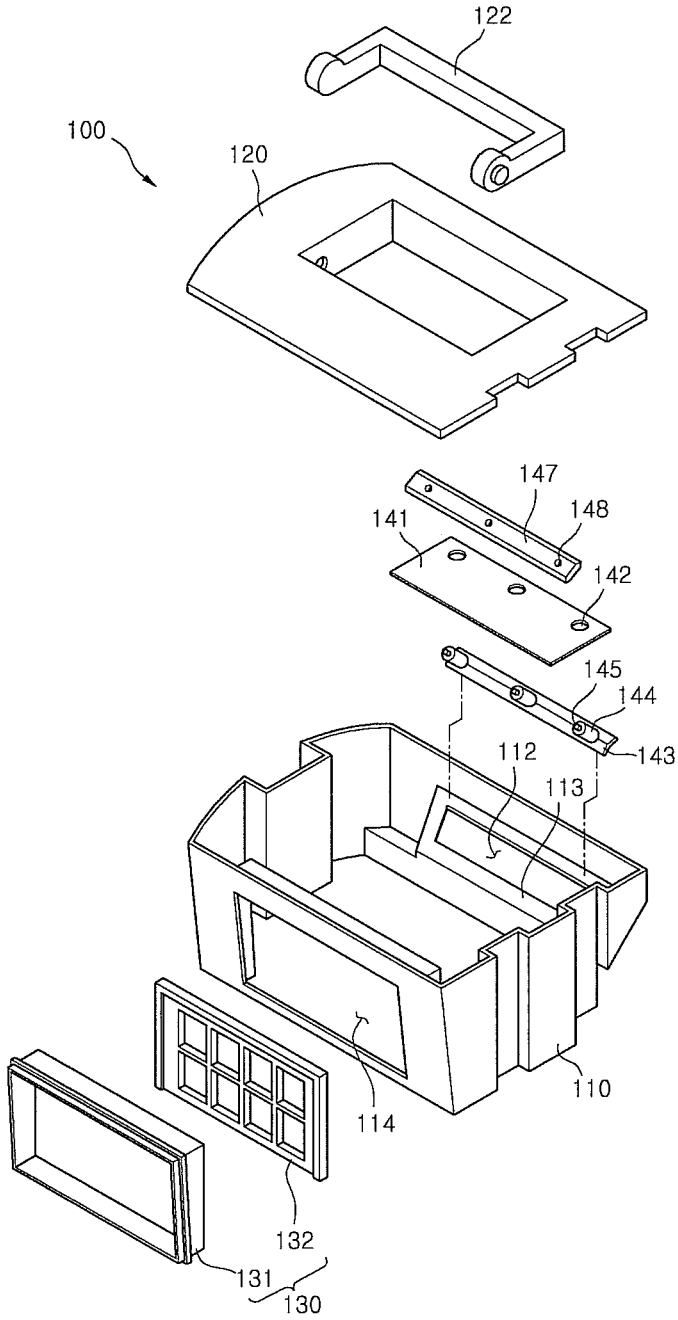
FIG. 3 is an exploded perspective view of a foreign material storage unit according to the first embodiment.
Figure 4:
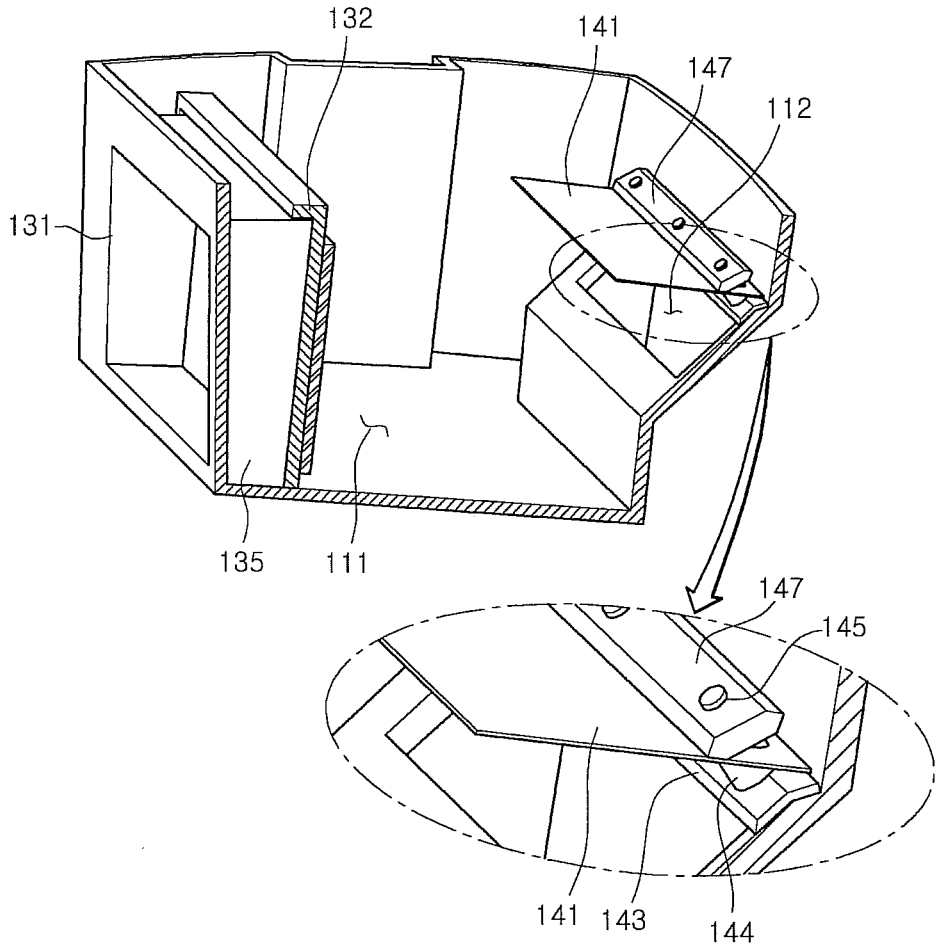
FIG. 4 is a sectional view of the foreign material storage unit according to the first embodiment.

FIG. 3 is an exploded perspective view of a foreign material storage unit according to the first embodiment. FIG. 4 is an exploded perspective view of a foreign material storage unit according to the first embodiment.

Referring to FIGS. 3 and 4, the foreign material storage unit 100 according to the first embodiment includes a storage unit main body 110 for defining a foreign material storage space 111 and a storage unit cover 120 for shielding an opened top surface of the storage unit main body 110.

The second communication part 112 communicating with the first communication part 23 is disposed at a side of the storage unit main body 110. Also, a motor-side opening 114 opened toward a side of the suction motor 12 is defined in the other side of the storage unit main body 110.

Also, a shield member 141 for selectively shielding the second communication part 112 is disposed inside the storage unit main body 110. The shield member 141 may be rotatably coupled to a side of the second communication part 112.

A support surface 113 for supporting the shield member 141 is disposed on a circumference of the second communication part 112. The shield member 141 may shield the second communication part 112 in a state where it 141 is supported by the support surface 113. The shield member 141 may have a size corresponding to the sum of those of the second communication part 112 and the support surface 113.

A coupling member 143 for coupling the shield member 141 to a side of the second communication part 112 is disposed on the storage unit main body 110. The coupling member 143 may be fixed to an upper side of the second communication part 112. However, the fixed position of the coupling member 143 is not limited thereto. For example, the coupling member 143 may be fixed to a left or right side or a lower side of the second communication part 112.

Also, a first coupling part 144 inserting the shield member 141 therein is inserted is disposed on the coupling member 143. The first coupling part 144 may protrude from one surface of the coupling member 143 toward an inside of the storage unit main body 110. The first coupling part 144 may be provided in at least one or more.

A first insertion hole 142 in which the first coupling part 144 is inserted is defined in the shield member 141. The first insertion hole 142 may be provided in size and number corresponding to those of the first coupling part 144.

An interference member 147 interfering with an upper portion of the shield member 141 when the shield member 141 is moved is disposed on a side of the shield member 141. A second insertion hole 148 coupled to the coupling member 143 is defined in the interference member 147. The second insertion hole 148 may have a size slightly less than that of the first insertion hole 142.

Also, a second coupling part 145 inserted into the second insertion hole 148 is inserted is disposed on the coupling member 143. The second coupling part 145 may extend upward from the first coupling part 144. Also, the second coupling part 145 may have a size slightly less than that of the first coupling part 144.

That is, the shield member 141 is inserted outside the first coupling part 144, and the interference member 147 is inserted outside the second coupling part 145.

Thus, the shield member 141 may be rotated with respect to a center of the first coupling part 144. Also, since the upper portion of the shield member 141 interferes with the interference member 147, it may prevent the shield member 141 from being separated from the coupling member 143.

When the suction motor 12 is operated, since a suction force is applied inward from the outside of the foreign material storage unit 100, the shield member 141 may be rotated in a direction in which the second communication part 112 is opened. On the other hand, when the operation of the suction motor 12 is stopped, since the suction force is not applied, the shield member 141 may be rotated in a direction in which the second communication part 112 is closed.

As described above, since the shield member 141 is closed when the suction motor 12 is not driven, the foreign materials within the storage space 111 do not flow backward to the outside. When the user separates the foreign material storage unit 100, the foreign materials may not be discharged to the outside.

A filter 135 for filtering the foreign materials sucked into the storage space 111 and first and second fixing parts 131 and 132 for fixing the filter 135 to the motor-side opening 114 are disposed in the motor-side opening 114.

The first and second fixing parts 131 and 132 may be disposed on one side and the other side of the filter 135, respectively. The foreign materials contained in the air sucked into the storage space 111 may be filtered, and the filtered air may pass through the motor-side opening 114 to flow into the suction motor 12.

Figure 5:
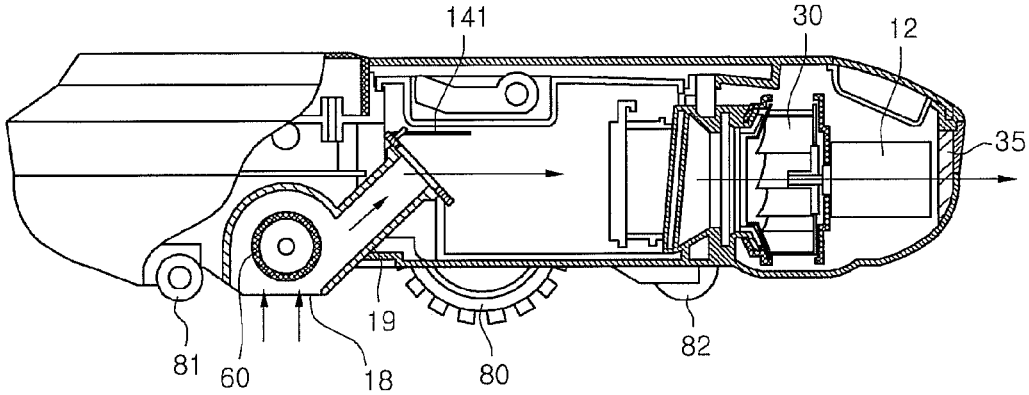
FIG. 5 is a sectional view taken along line I-I' of FIG. 1.

FIG. 5 is a sectional view taken along line I-I' of FIG. 1.

Referring to FIG. 5, the robot cleaner 1 according to the first embodiment includes a suction part 18 for sucking foreign materials from the cleaning surface, the agitator 60 rotatably disposed above the suction part 18, and a connection pipe 19 extending from the suction part 18 toward the foreign material storage unit 100. The connection pipe 19 may be inclinedly disposed from the suction part 18 toward a rear upper side of the suction part 18.

A suction motor 12 for providing a suction force and a blower 30 are disposed at a rear side of the foreign material storage unit 100. The blower 30 may be disposed on at a front side of the suction motor 12.

An exhaust filter 35 for filtering fine foreign materials contained in the air passing through the suction motor 12 is disposed at a rear side of the suction motor 12. A first auxiliary wheel 81 and a second auxiliary wheel 82 for easily moving the robot cleaner 1 may be disposed at front and rear sides of the moving wheel 80, respectively.

An airflow according to the current embodiment will be described below.

The air containing the foreign materials sucked through the suction part 18 may be introduced into the foreign material storage unit 100 via the connection pipe 19. The foreign materials contained in the introduced air may be filtered by the filter 135. Then, the filtered air may pass through the exhaust filter 35 via the suction motor 12. The air passing through the exhaust filter 35 may be exhausted to the outside of the robot cleaner 1.

As shown in FIG. 5, the air sucked through the suction part 18 may flow backward from the foreign material storage unit 100 to the exhaust filter 35 via the connection pipe 19. That is, the air may flow straightly without being turned from one direction to the other direction to minimize a flow loss, thereby improving suction performance.

Figure 6:
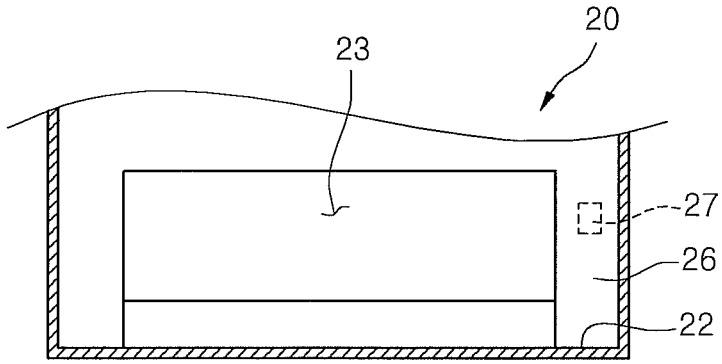
FIG. 6 is a sectional view taken along line II-II' of FIG. 2.
Figure 7:
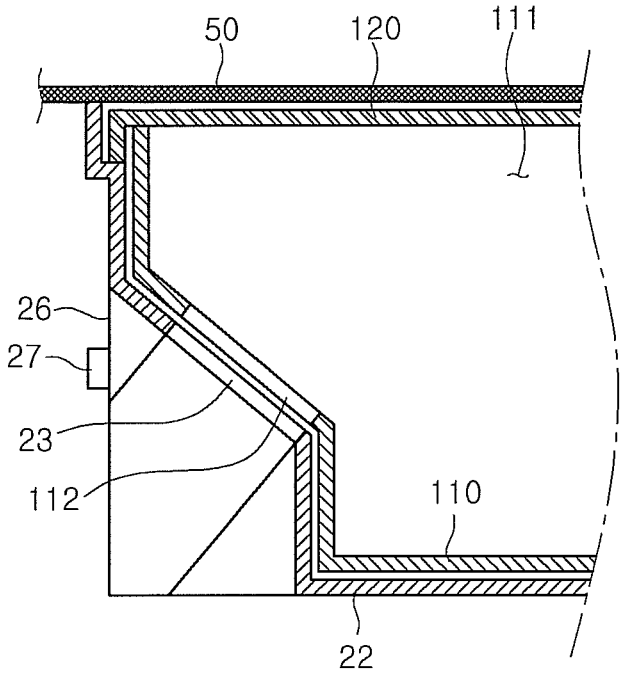
FIG. 7 is a sectional view of a detection unit according to the first embodiment.

FIG. 6 is a sectional view taken along line II-II' of FIG. 2. FIG. 7 is a sectional view of a detection unit according to the first embodiment.

Referring to FIGS. 6 and 7, a detection unit 27 for detecting a movement of a shield member 141 is disposed on a first cover 20 according to a second embodiment. The detection unit 27 may include an infrared sensor.

The detection unit 27 may be disposed on a side of a wall 26 in which the first communication part 23 is defined. That is, the wall 26 may be disposed along a circumference of the first communication part 23, and the detection unit 27 may be disposed on a side of the first communication part 23. In a state where a foreign material storage unit 100 is seated on the seat part 22, the wall 26 may be disposed on a position corresponding to the storage unit main body 110 of the foreign material storage unit 100 or the storage unit cover 120.

Here, the wall 26 may be formed of a transparent material to allow the detection unit 27 to easily detect the shield member 110. Each of the storage unit main body 110 or the storage unit cover 120 may be formed of an opaque material. In this case, a signal transmitted from the detection unit 27 may pass through the wall 26 and then be reflected by the storage unit main body 110 or the storage unit cover 120 to come back.

In a state where a foreign material storage unit 100 is mounted, the detection unit 27 may detect the storage unit main body 110 or the storage unit cover 120 to detect the mounting of the foreign material storage unit 100. On the other hand, when the foreign material storage unit 100 is not mounted, the detection unit 27 may detect this state in which the foreign material storage unit 100 is not mounted to transmit a signal corresponding to the state to a control part (not shown) of the robot cleaner 1.

When the cleaner is operated in the state where the foreign material storage unit 100 is not mounted, the control unit may alarm this state through an alarming unit (not shown). The alarming unit may include a display or an alarming lamp.

In the current embodiment, the detection unit 27 is disposed on the wall 26. However, the detection unit 27 may be disposed on a predetermined position of a main body 10 corresponding to that of the wall 26.

Hereinafter, descriptions will be made according to a second embodiment. Since the current embodiment is the same as the first embodiment except for a position of a detection unit, different parts between the first and second embodiments will be described principally, and descriptions of the same parts will be denoted by the same reference numerals and descriptions of the first embodiment.

Figure 8:
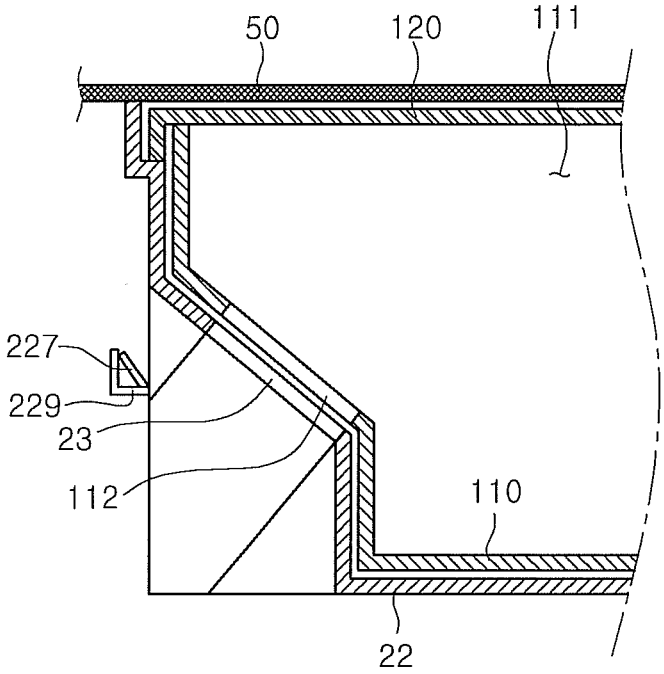
FIG. 8 is a sectional view of a detection unit according to a second embodiment.

FIG. 8 is a sectional view of a detection unit according to a second embodiment. Referring to FIG. 8, a robot cleaner 1 according to a second embodiment includes a second detection unit 227 for detecting whether a second cover 50 is opened. The second detection unit 227 may be disposed on a side of the wall 26 and inclined upward toward the second cover 50.

Also, a support member 229 for supporting at least one side of the second detection unit 227 is disposed on the wall 26. The support member 229 may have a bent shape to allow the second detection unit 227 to be inclinedly disposed.

Although the support member 229 has an "L" shape in FIG. 8, the present disclosure is not limited thereto. For example, the support member 229 may have various shapes to the second detection unit 227 to be inclinedly supported.

The storage unit main body 110 or the storage unit cover 120 may be formed of a transparent material to allow the second detection unit 227 to easily detect whether the second cover 50 is opened. Also, the second cover 50 may be formed of an opaque material. In this case, a signal transmitted from the second detection unit 227 may pass through the storage unit main body 110 or the storage unit cover 120 and then be reflected by the second cover 50 to come back. Thus, the second detection unit 227 may detect the opened state of the second cover 50.

Hereinafter, descriptions will be made according to a third embodiment. Since the current embodiment is the same as the first embodiment except for a detection unit, different parts between the first and second embodiments will be described principally, and descriptions of the same parts will be denoted by the same reference numerals and descriptions of the first embodiment.

Figure 9:
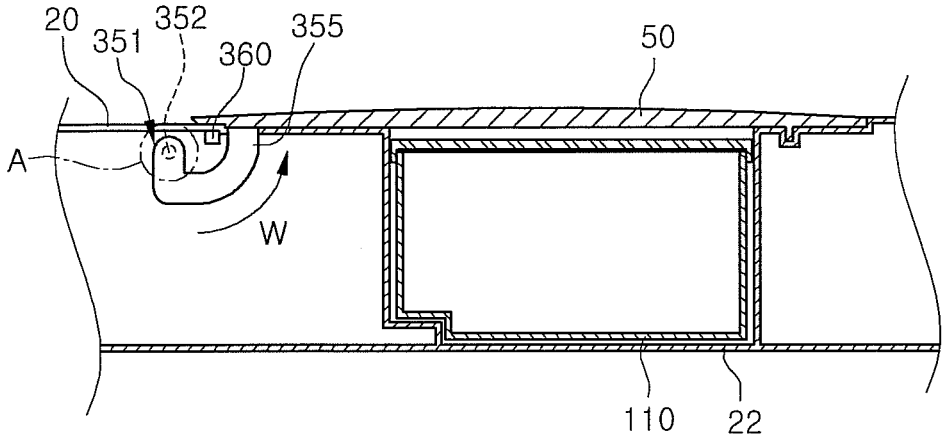
FIG. 9 is a sectional view of a second cover and a foreign material storage unit according to a third embodiment.
Figure 10:
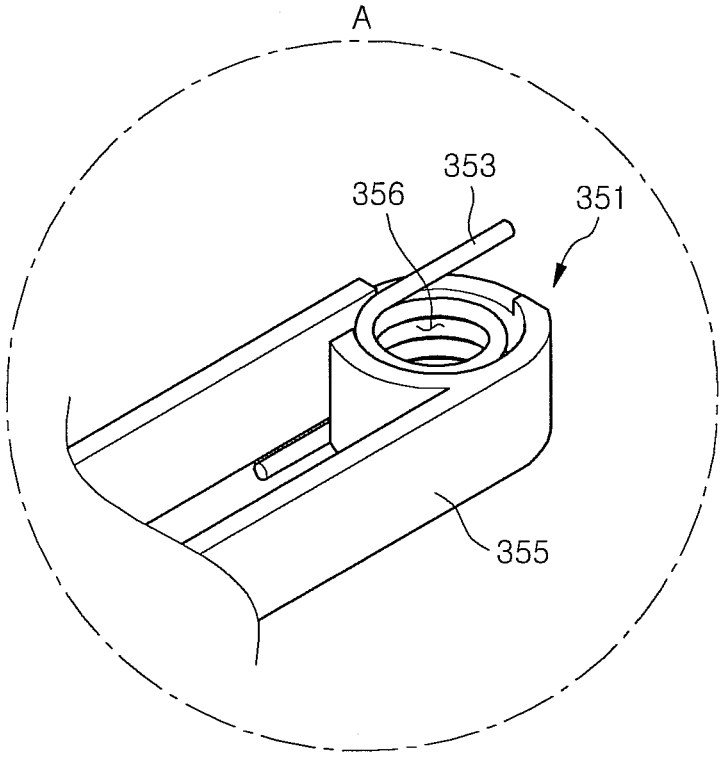
FIG. 10 is a view illustrating a portion "A" of FIG. 9.

FIG. 9 is a sectional view of a second cover and a foreign material storage unit according to a third embodiment. FIG. 10 is a view illustrating a portion "A" of FIG. 9.

Referring to FIGS. 9 to 10, a second cover 50 according to a third embodiment include a hinge part 351 for rotating a second cover 50 and a rotation lever 355 connecting the second cover 50 and the hinge part 351 and extending from the hinge part 251 in one direction.

In detail, the hinge part 351 includes a rotation shaft 352 providing a rotation center of the second cover 50, a rotation shaft insertion part 356 disposed on the rotation lever 355 and in which the rotation shaft 352 is inserted, and an elastic member 353 disposed on the rotation shaft insertion part 356 to provide a restoring force to the rotation lever 355.

The rotation shaft 352 may be disposed within a first cover 20 and inserted into the rotation shaft insertion part 356. Thus, the rotation shaft 352 may be coupled to the rotation lever 355.

The elastic member 353 may be disposed along an inner circumference of the rotation shaft insertion part 356 to surround the outside of the rotation shaft 352. The elastic member 353 may provide the restoring force in a direction in which the second cover 50 is opened. The elastic member 353 may include a torsion spring.

The second cover 50 and the rotation lever 355 may be rotated in a clockwise or counter clockwise direction with respect to a center of the hinge part 351. In detail, when the second cover 50 is closed, when a hook protrusion 51 is hooked on a hook 21 to couple the second cover 50 to the first cover 20, the second cover 50 may overcome the restoring force of the elastic member 353 to maintain the closed state.

On the other hand, when the hooked state between the hook protrusion 51 and the hook 21 is released, the second cover 50 may be rotated in a direction in which the second cover 50 is opened by the restoring force of the elastic member 353.

Also, a second detection unit 360 for detecting whether the second cover 50 is opened is disposed inside the first cover 20. The second detection unit 360 may include a detection switch turned on/off by contact.

In detail, the second detection unit 360 may be disposed on an inner surface of the first cover 20. Also, the second detection unit 360 may be disposed around the hinge part 351 and within a rotation radius of the rotation lever 355.

When the rotation lever 355 is rotated in a direction (a W direction) in which the second cover 50 is opened, a side of the rotation lever 355 may contact the second detection unit 360. In this process, the second detection unit 360 is turned on.

When the second detection unit 360 is turned on, a control unit (not shown) of the cleaner receives the ON signal of the second detection unit 360 to recognize that the second cover 50 is opened.

Also, the control unit may alarm the opening of the second cover 50 through an alarming unit (not shown) described in the first embodiment. The alarming unit may include a display or an alarming lamp.

On the other hand, when the second cover 50 is closed, the rotation lever 355 is spaced from the second detection unit 360. In this process, the second detection unit 360 is turned off. When the second detection unit 360 is turned off, the control unit may recognize the closed state of the second cover 50.

Hereinafter, descriptions will be made according to a fourth embodiment. Since the current embodiment is the same as the foregoing embodiments except for a detection unit, different parts between the current embodiment and the foregoing embodiments will be described principally, and descriptions of the same parts will be denoted by the same reference numerals and descriptions of the foregoing embodiments.

Figure 11:
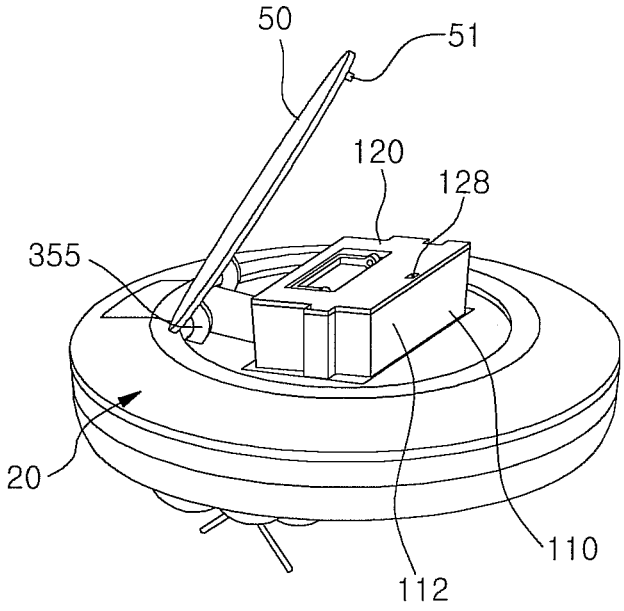
FIG. 11 is a sectional view of a first cover and a foreign material storage unit according to a fourth embodiment.
Figure 12:
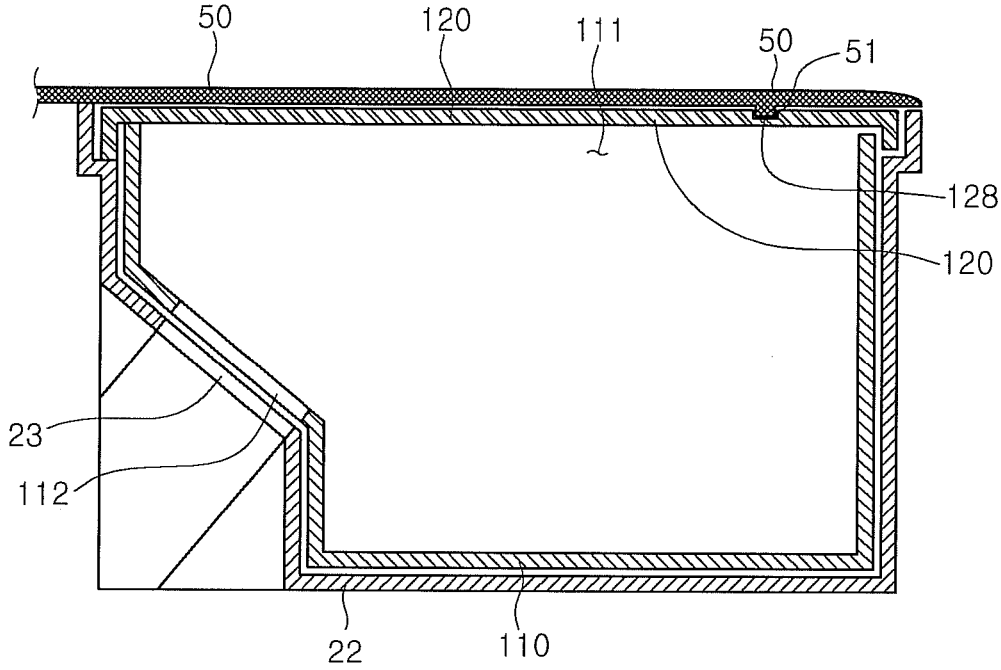
FIG. 12 is a sectional view illustrating a coupled state of the foreign material storage unit according to the fourth embodiment.

FIG. 11 is a sectional view of a first cover and a foreign material storage unit according to a fourth embodiment. FIG. 12 is a sectional view illustrating a coupled state of the foreign material storage unit according to the fourth embodiment.

Referring to FIGS. 11 and 12, a hook groove 128 hooked with a hook protrusion 51 of a second cover 50 is defined in a foreign material storage unit 100 according to the fourth embodiment.

In the state where the second cover 50 is closed, the hook protrusion 51 may be hooked with the hook groove 128. The hooked structure between the hook protrusion 51 and the hook groove 128 may be equal to that between the hook protrusion 51 and the hook part 21 which are described in the first embodiment.

On the other hand, in a state where the foreign material storage unit 100 is separated from the first cover 20, the hooking of the hook protrusion 51 may be realized even though the second cover 50 is closed. The second cover 50 may be maintained in the opened state by the restoring force of the elastic member 353.

Thus, the user may easily know the state in which the foreign material storage unit 100 is separated from the cleaner. Accordingly, in the state where the foreign material storage unit 100 is separated, the cleaner may not be operated.

As described above, the separation of the foreign material storage unit 100 may be easily known, and thus, thus user may easily manipulate the cleaner.

According to the embodiments, since the detection unit may be disposed on the main body or cover of the cleaner to detect whether the foreign material storage unit is mounted, the cleaner may not be operated in the state where the foreign material storage unit is not mounted.

Also, since whether the foreign material cover of the cleaner is opened may be detected by the detection unit, it may prevent the cleaner from being operated in the state where the foreign material cover is opened.

Also, since the hook structure may be provided to each of the foreign material storage unit and the foreign material cover, the foreign material cover is not closed in the state where the foreign material storage unit is not mounted. Thus, the user may easily recognize the state in which the foreign material storage unit is not mounted.

Also, since the detection switch may be disposed around the hinge part of the rotatably disposed foreign material cover and the switch may be turned on/off according to the opening of the foreign material cover, the user may easily recognize the opening of the foreign material cover.

Also, since whether the foreign material storage unit is mounted or the foreign material cover is opened may be easily known to the outside, the convenience of use and reliability of product may be improved.

Since the separation of the foreign material storage unit or the opening of the foreign material cover may be easily detected in the embodiments, the industrial applicability may be significantly high.

What is claimed is:

1. A robot cleaner comprising:

a main body comprising a suction motor;

a foreign material storage unit separably disposed within the main body, the foreign material storage unit storing foreign materials contained in sucked air;

a foreign material cover for selectively shielding one side of the foreign material storage unit; and a detection unit disposed on another side of the foreign material storage unit, the detection unit configured to detect whether the foreign material storage unit is separated from the main body or the foreign material cover is opened.

2. The robot cleaner according to claim 1, further comprising a main cover for shielding at least one side of the main body, wherein a seat part for seating the foreign material storage unit is disposed on the main cover.

3. The robot cleaner according to claim 2, wherein the main cover comprises a wall on which the detection unit is disposed, and the wall is disposed on a side of the seat part.

4. The robot cleaner according to claim 3, wherein the wall is formed of a transparent material, and the foreign material storage unit or the foreign material cover is formed of an opaque material.

5. The robot cleaner according to claim 1, further comprising a support member so that the detection unit is inclinedly supported toward the foreign material cover.

6. The robot cleaner according to claim 2, further comprising:

a rotation lever configured to rotatably couple the foreign material cover to the main cover; and a hinge part defining a rotation center of the rotation lever.

7. The robot cleaner according to claim 6, wherein the detection unit is disposed within a rotation radius of the rotation lever and selectively turned on/off by contact of the rotation lever.

8. The robot cleaner according to claim 1, wherein a hook groove to which a hook protrusion of the foreign material cover is coupled is defined in the foreign material storage unit.

9. The robot cleaner according to claim 8, further comprising an elastic member for providing a restoring force in a direction in which the foreign material cover is opened.

10. The robot cleaner according to claim 1, wherein the detection unit comprises at least one of an infrared sensor and a detection switch that is selectively turned on/off.

* * * * *